US012540008B2

(12) United States Patent
Suruga et al.

(10) Patent No.: US 12,540,008 B2
(45) Date of Patent: Feb. 3, 2026

(54) PACKING BODY

(71) Applicant: FUJIFILM Business Innovation Corp., Tokyo (JP)

(72) Inventors: Misaki Suruga, Kanagawa (JP); Naoto Chiba, Kanagawa (JP); Yusuke Kabe, Kanagawa (JP); Seiya Imai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 18/783,383

(22) Filed: Jul. 24, 2024

(65) Prior Publication Data

US 2024/0375820 A1 Nov. 14, 2024

Related U.S. Application Data

(63) Continuation of application No. 17/389,378, filed on Jul. 30, 2021, now abandoned.

(30) Foreign Application Priority Data

Mar. 23, 2021 (JP) ..... 2021-048576

(51) Int. Cl.
*B65D 19/44* (2006.01)
*B65D 19/06* (2006.01)

(52) U.S. Cl.
CPC ..... *B65D 19/44* (2013.01); *B65D 19/06* (2013.01); *B65D 2519/00497* (2013.01); *B65D 2519/00537* (2013.01); *B65D 2519/00815* (2013.01)

(58) Field of Classification Search
CPC ..... B65D 19/44; B65D 19/06; B65D 19/00; B65D 2519/00815; B65D 85/30; B65D 2585/6892

(Continued)

(56) References Cited

U.S. PATENT DOCUMENTS 9,676,514 B1 * 6/2017 Gamez ..... B65D 19/0069
2004/0035872 A1 * 2/2004 Garfinkle ..... B65D 71/0096 220/630

(Continued)

FOREIGN PATENT DOCUMENTS

CN 201545317 8/2010
CN 209701171 11/2019

(Continued)

OTHER PUBLICATIONS

"Office Action of China Counterpart Application", issued on Jul. 23, 2024, with English translation thereof, pp. 1-3.

(Continued)

*Primary Examiner* — Robert Poon
(74) *Attorney, Agent, or Firm* — JCIPRNET

(57) ABSTRACT

A packing module includes a packed body and a packing body configured to accommodate the packed body. The packing body includes a bottom plate on which the packed body is placed, a box body that covers the packed body, and a restricting member, of which one end is fixed to the bottom plate and the other end protrudes toward a base body of the packed body with a gap and that restricts lateral movement of the packed body by coming into contact with the base body of the packed body in a case where the packed body has moved laterally. The restricting member is configured to penetrate through a hole provided in the base body of the packed body. Clearance between the restricting member and the hole of the base body is larger than a gap between an inner surface of the box body and the packed body.

15 Claims, 13 Drawing Sheets

(58) Field of Classification Search
USPC ..... 206/386, 320, 598
See application file for complete search history.

(56) References Cited

U.S. PATENT DOCUMENTS

| | | | | |
|---|---|---|---|---|
| 2004/0258330 | A1* | 12/2004 | Kido | B65D 88/1687 383/16 |
| 2010/0213088 | A1* | 8/2010 | Goda | B65D 19/06 206/386 |
| 2013/0276676 | A1* | 10/2013 | Kokatsu | B65D 81/02 108/55.1 |
| 2014/0209600 | A1* | 7/2014 | Schloesser | B65D 9/12 220/4.33 |
| 2015/0210426 | A1* | 7/2015 | Funaki | B65D 19/385 108/53.3 |
| 2018/0305067 | A1* | 10/2018 | Iwahara | B65D 19/20 |

FOREIGN PATENT DOCUMENTS

| | | |
|---|---|---|
| DE | 202004017500 | 1/2005 |
| JP | 2005239224 | 9/2005 |
| JP | 2017001715 | 1/2017 |

OTHER PUBLICATIONS

"Office Action of China Counterpart Application", issued on Aug. 20, 2025, with English translation thereof, p. 1-p. 12.

* cited by examiner

PACKING BODY

CROSS-REFERENCE TO RELATED APPLICATIONS

This application is a continuation application and claims the priority benefit of U.S. patent application Ser. No. 17/389,378, filed on Jul. 30, 2021. The prior U.S. patent application Ser. No. 17/389,378 is based on and claims priority under 35 USC 119 from Japanese Patent Application No. 2021-048576 filed Mar. 23, 2021. The entirety of each of the above-mentioned patent applications is hereby incorporated by reference herein and made a part of this specification.

BACKGROUND

(i) Technical Field

The present invention relates to a packing body.

(ii) Related Art

There is known a heavy object packing device including a pallet, a heavy object that has a storage chamber in a cabinet placed on the pallet, a corrugated outer box that covers the heavy object, and a band that couples the outer box and the pallet to each other. In the heavy object packing device, the pallet and the heavy object are connected to each other by a connecting fitting, the heavy object and the outer box are fixed to each other by a mounting fitting fixed to the heavy object and a fastening bolt screwed with the mounting fitting, and a washer having a protrusion protruding toward an outer box side is interposed between the bolt and the outer box (JP1995-149348A).

There is also known a pallet including columnar girder members, the plurality of girder members being provided to be arranged in parallel with each other at an interval in one direction, a reinforcing member that consists of corrugated paper, the reinforcing member having a rectangular base part, to which the plurality of girder members are fixed, and two reinforcing wall parts, which are connected to the base part and rise perpendicularly to the base part from each of sides of the base part perpendicular to a longitudinal direction of the girder members, and a recessed deck part that consists of corrugated paper, the deck part having a rectangular bottom part fixed to the base part while overlapping the base part and a first wall part, which rises perpendicularly to the bottom part from each of the sides of the bottom part perpendicular to the longitudinal direction of the girder members and to which the two reinforcing wall parts are fixed respectively (JP2019-156478A).

SUMMARY

Aspects of non-limiting embodiments of the present disclosure relate to a packing body that does not have a buffer material between the packing body and a packed body, and prevents an impact on the packed body at the time of transporting.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a packing body including a bottom plate on which a packed body is placed, a box body that covers the packed body, and a restricting member, of which one end is fixed to the bottom plate and the other end protrudes toward a part of the packed body with a gap and that restricts lateral movement of the packed body by coming into contact with the part of the packed body in a case where the packed body has moved laterally, in which clearance between the restricting member and the part of the packed body is larger than a gap between an inner surface of the box body and the packed body, and the clearance is defined as a movement amount obtained by adding an elastic deformation amount of the restricting member in a case where the packing body has received a horizontal impact to the gap between the restricting member and the part of the packed body.

BRIEF DESCRIPTION OF THE DRAWINGS

Exemplary embodiment(s) of the present invention will be described in detail based on the following figures, wherein.

DETAILED DESCRIPTION

Next, the present invention will be described in more detail with reference to the drawings by giving an exemplary embodiment and a specific example below, but the present invention is not limited to the exemplary embodiment and the specific example.

In addition, in the description using the drawings below, it is to be noted that the drawings are schematic, the ratio of each dimension is different from the actual ratio, and members that are not necessary for the description to facilitate understanding will not be shown as appropriate.

(1) Configuration of Packing Body

Figure 1:
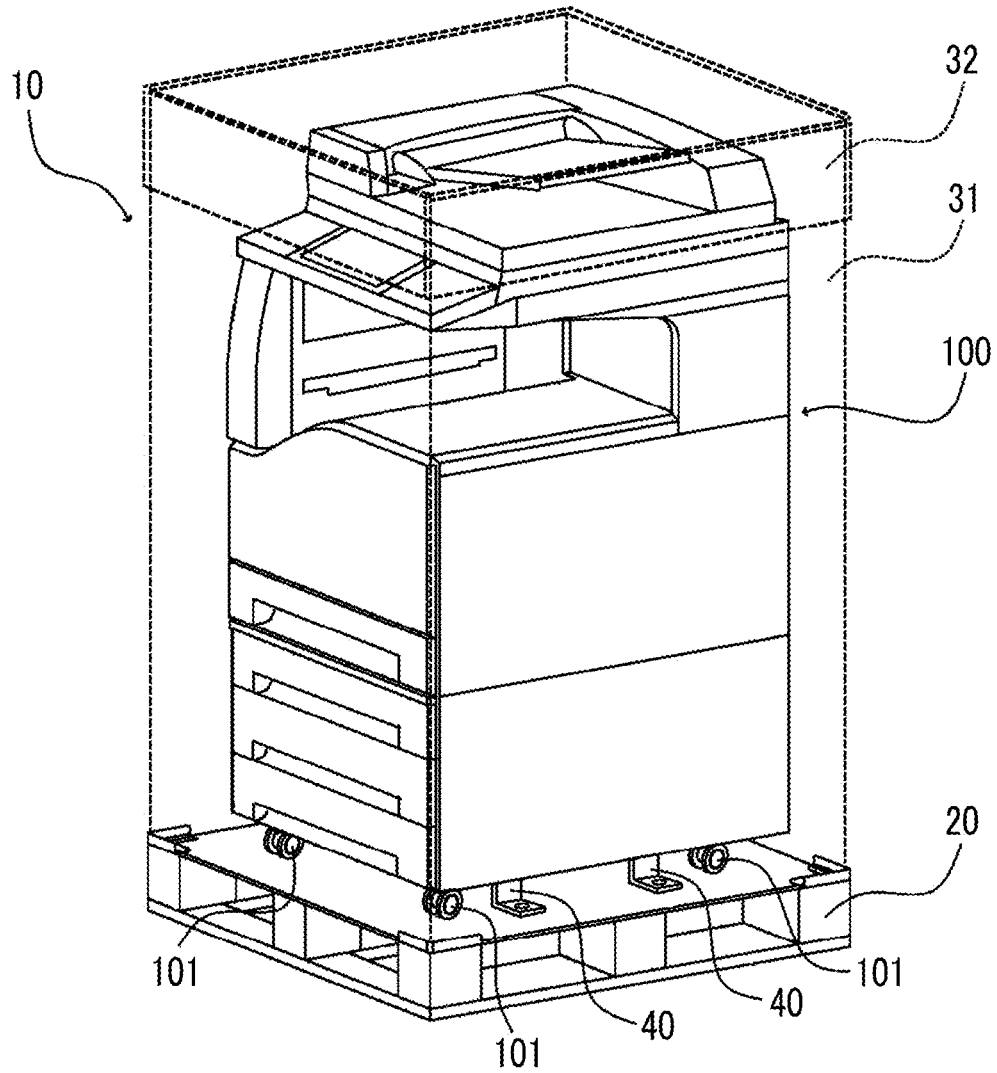
FIG. 1 is an overall perspective view showing an outline of a packing form using a packing body according to the present exemplary embodiment.
Figure 2:
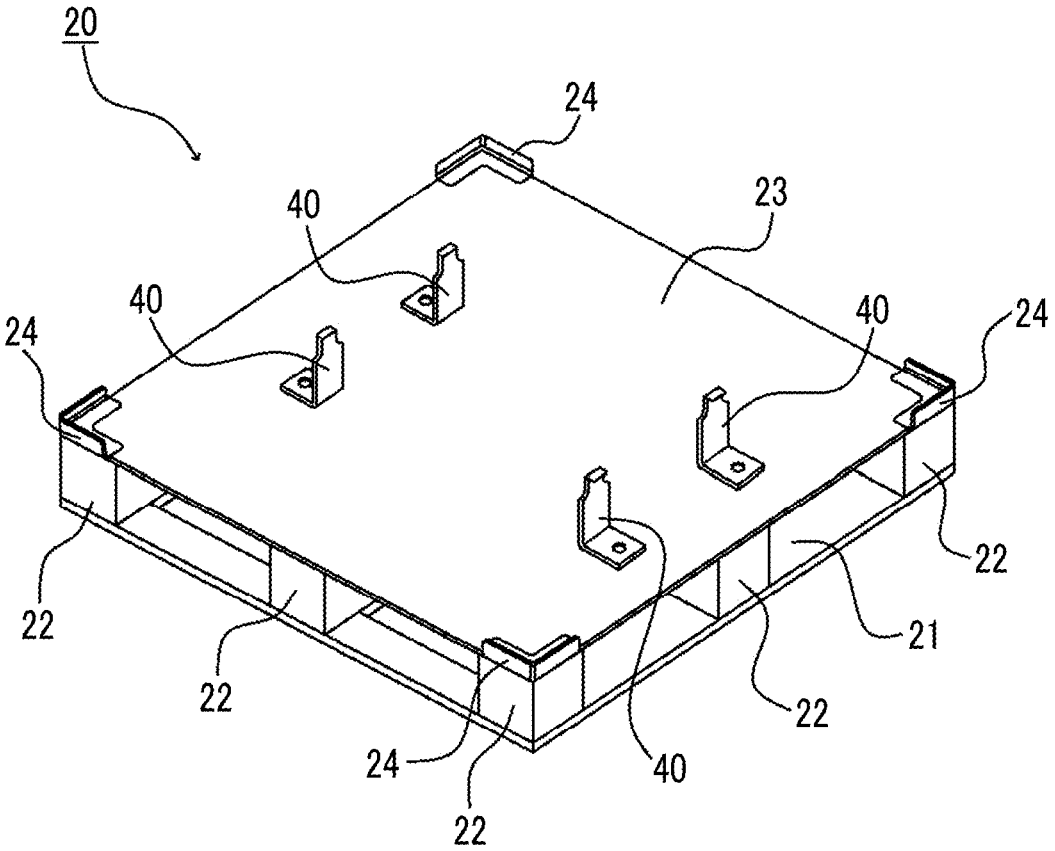
FIG. 2 is a perspective view showing an outline of a pallet of the packing body according to the present exemplary embodiment.
Figure 3:
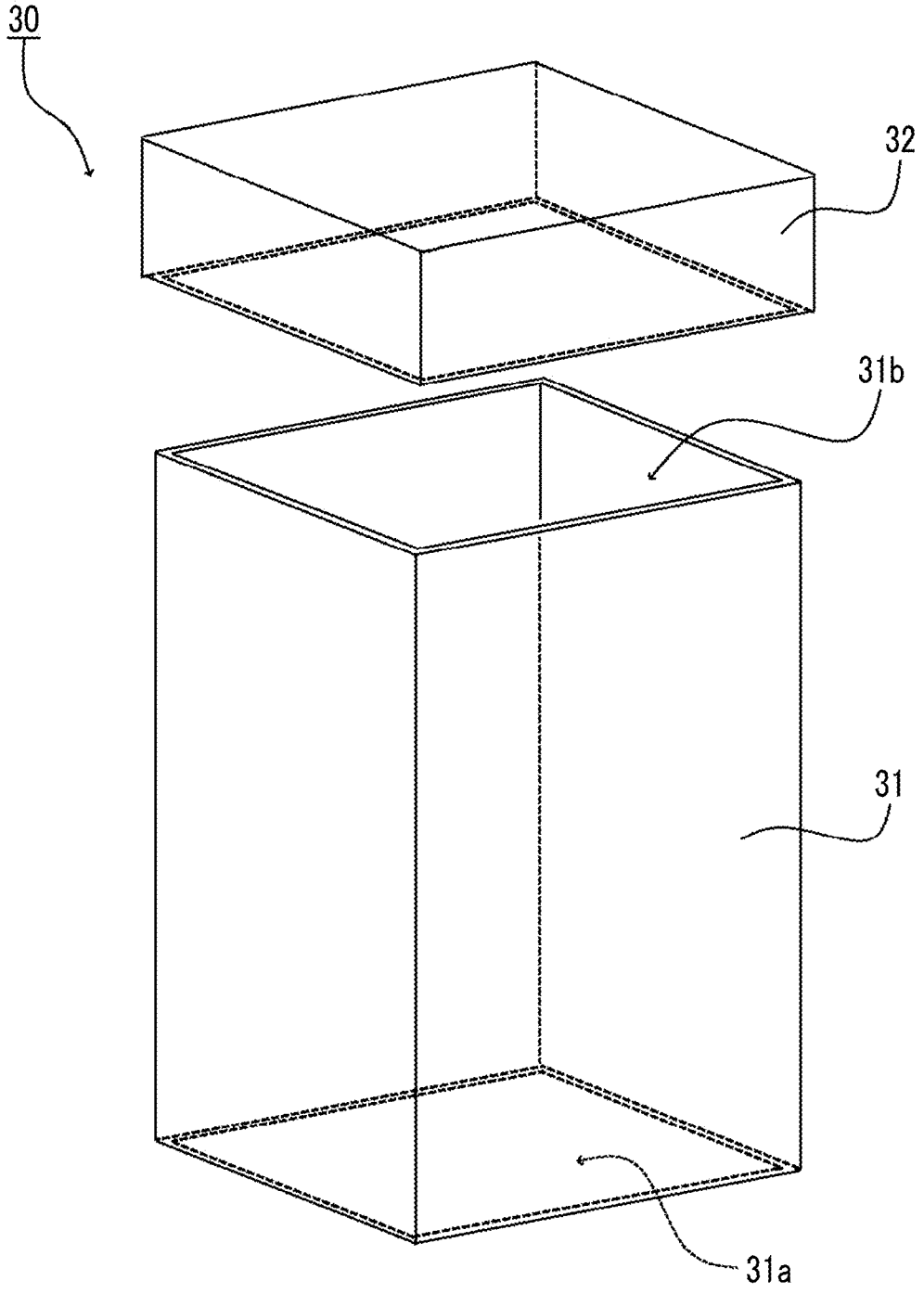
FIG. 3 is an exploded perspective view of a box body.
Figure 4A:
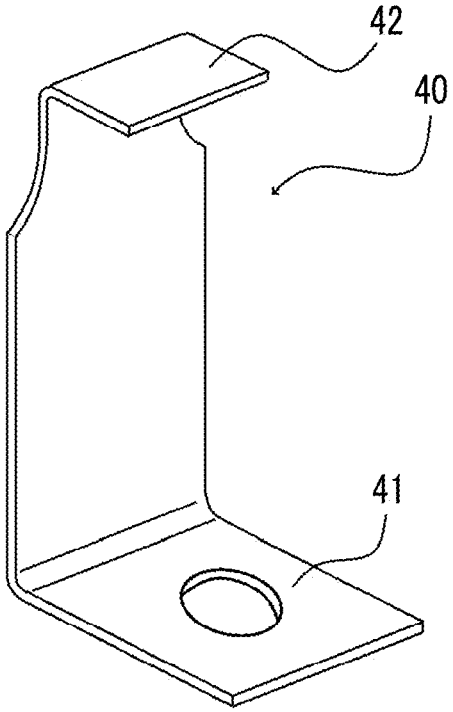
FIG. 4A is a perspective view showing an outline of a restricting member.
Figure 4B:
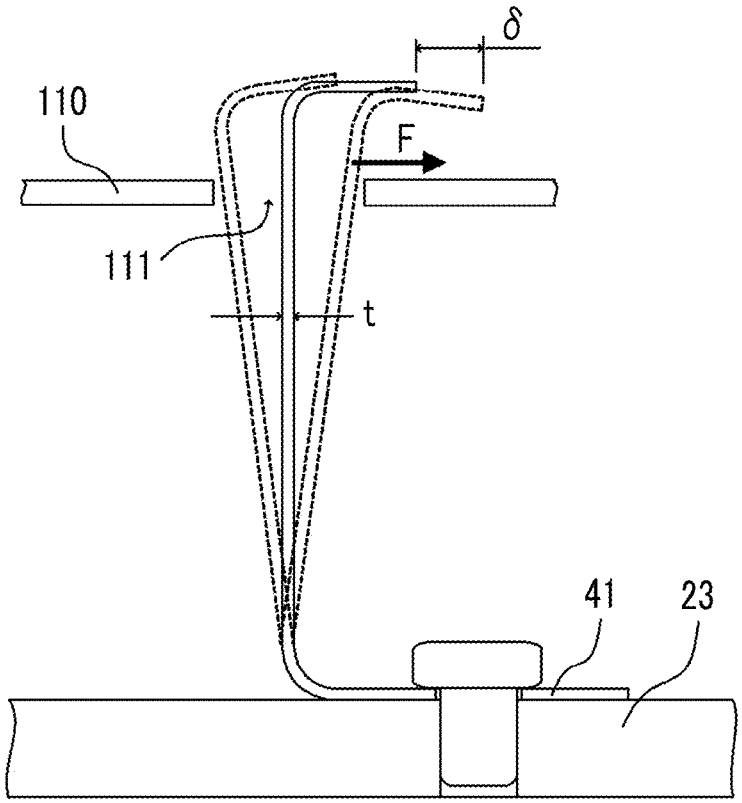
FIG. 4B is a view for describing elastic deformation of the restricting member.

FIG. 1 is an overall perspective view showing the outline of a packing form using a packing body 10 according to the present exemplary embodiment. FIG. 2 is a perspective view showing the outline of a pallet 20 of the packing body 10 according to the present exemplary embodiment. FIG. 3 is an exploded perspective view of a box body 30. FIG. 4A is a perspective view showing the outline of a restricting member 40, and FIG. 4B is a view for describing elastic deformation of the restricting member 40. Hereinafter, an overall configuration and the packing form of the packing body 10 will be described with reference to the drawings.

The packing body 10 consists of the pallet 20, the box body 30, and the restricting member 40. As shown in FIG. 1, in a state where the lateral movement of a packed body 100 is restricted by the restricting member 40 and is placed on the pallet 20, the packed body 100 is packed by being covered with the box body 30. In FIG. 1, in order to show the packed body 100, the box body 30 covering the packed body 100 is shown by a broken line.

The pallet 20 according to the present exemplary embodiment is an example of a bottom plate, and is configured by, for example, a wooden bottom plate member 21 that forms a bottom surface, a wooden girder member 22 configured by a plurality of vertical girders and horizontal girders provided on the bottom plate member 21, and a wooden top plate member 23 that is provided on the girder member 22 and forms a top surface, as shown in FIG. 2. Positioning members 24 that position a lower end part of the box body 30 are provided at four corners of the top plate member 23.

The box body 30 is configured by a quadrangle tubular body part 31 that consists of a corrugated sheet and a lid part 32 that closes an opening 31*a* provided in an upper part of the body part 31.

The body part 31 has a size that allows a relatively heavy electronic device including a caster 101 to be accommodated, which is the packed body 100, and a lower end part and an upper end part thereof are opened. In a state where the packed body 100 is placed on the pallet 20, the body part passes so as to wrap the packed body 100 from the opening 31*a* in a lower part and is positioned on the top plate member 23 of the pallet 20 by the positioning members 24.

The lid part 32 is a lid that closes an opening 31*b* in the upper end part of the body part 31 that is passed through and covers the packed body 100, and is formed by a corrugated sheet.

Hereinafter, the box body 30 will be referred to as the box body 30 without distinguishing between the body part 31 and the lid part 32.

The restricting member 40 is a sheet metal plate member that can deform elastically, and has a base part 41 fixed on the top plate member 23 of the pallet 20 and a hook part 42 that enters a hole 111 (see FIG. 4B) provided in a bottom surface of the packed body 100 and presses floating of the packed body 100 from the pallet 20, as shown in FIG. 4A. As shown in FIG. 4B, in a case where an external force F is applied in a horizontal direction, the restricting member 40 is capable of deforming elastically. The restricting member 40 is formed of high strength steel as a material.

(2) Packing Form of Packed Body

Figure 5:
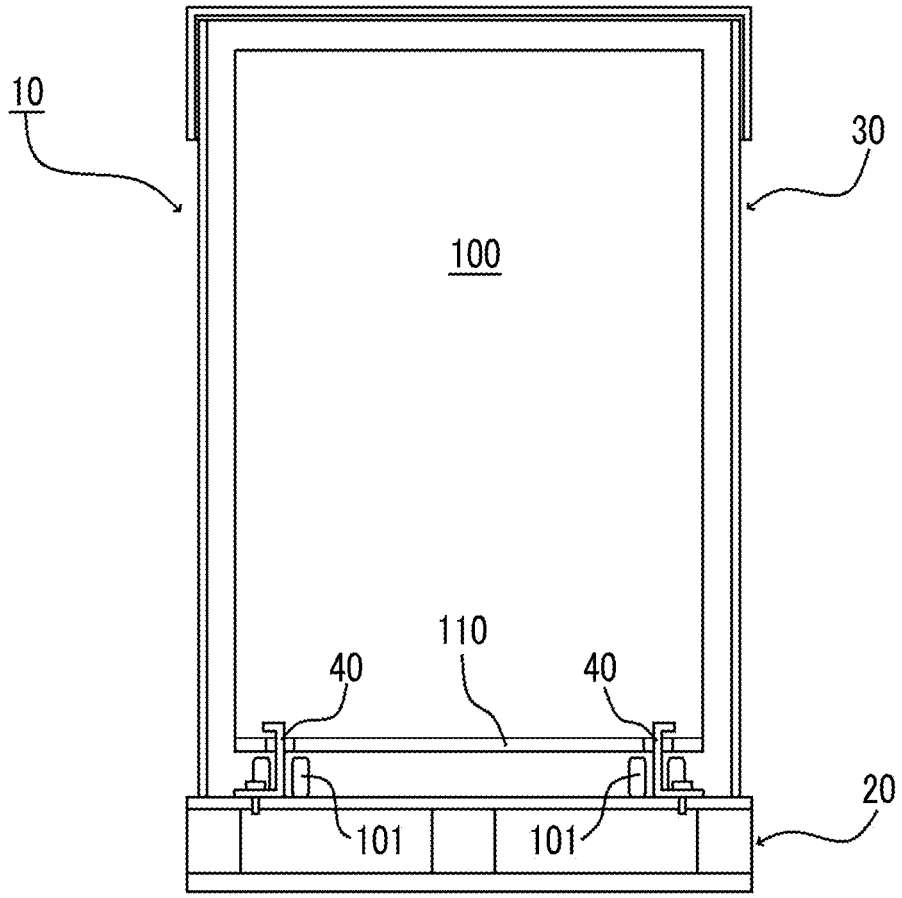
FIG. 5 is a schematic cross-sectional view showing the packing form of a packed body using the packing body.
Figure 6B:
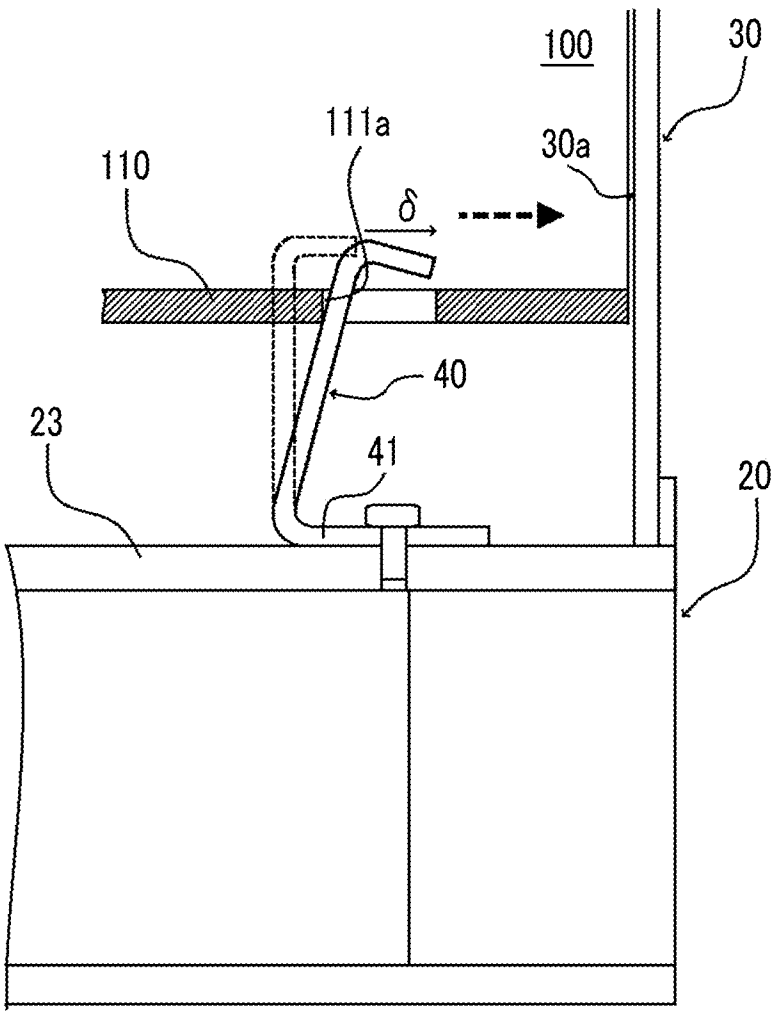
FIGS. 6A and 6B are partially enlarged views for describing placement of the packed body on the pallet by the restricting member.
Figure 6A:
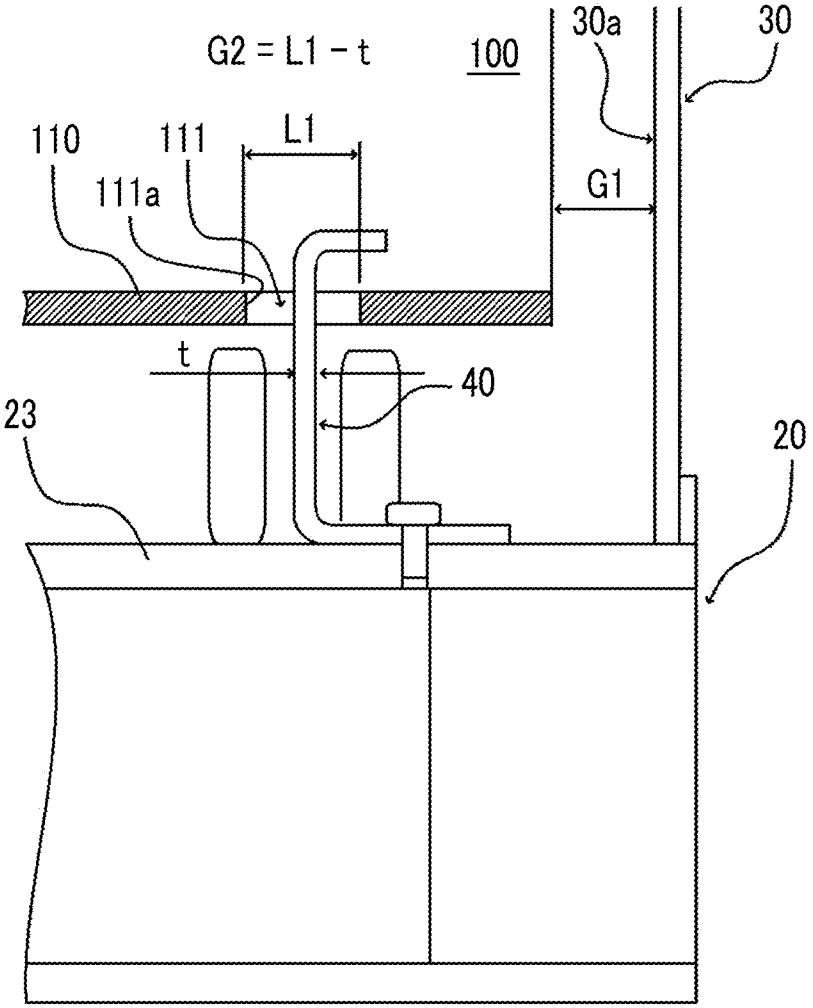
Figure 12:
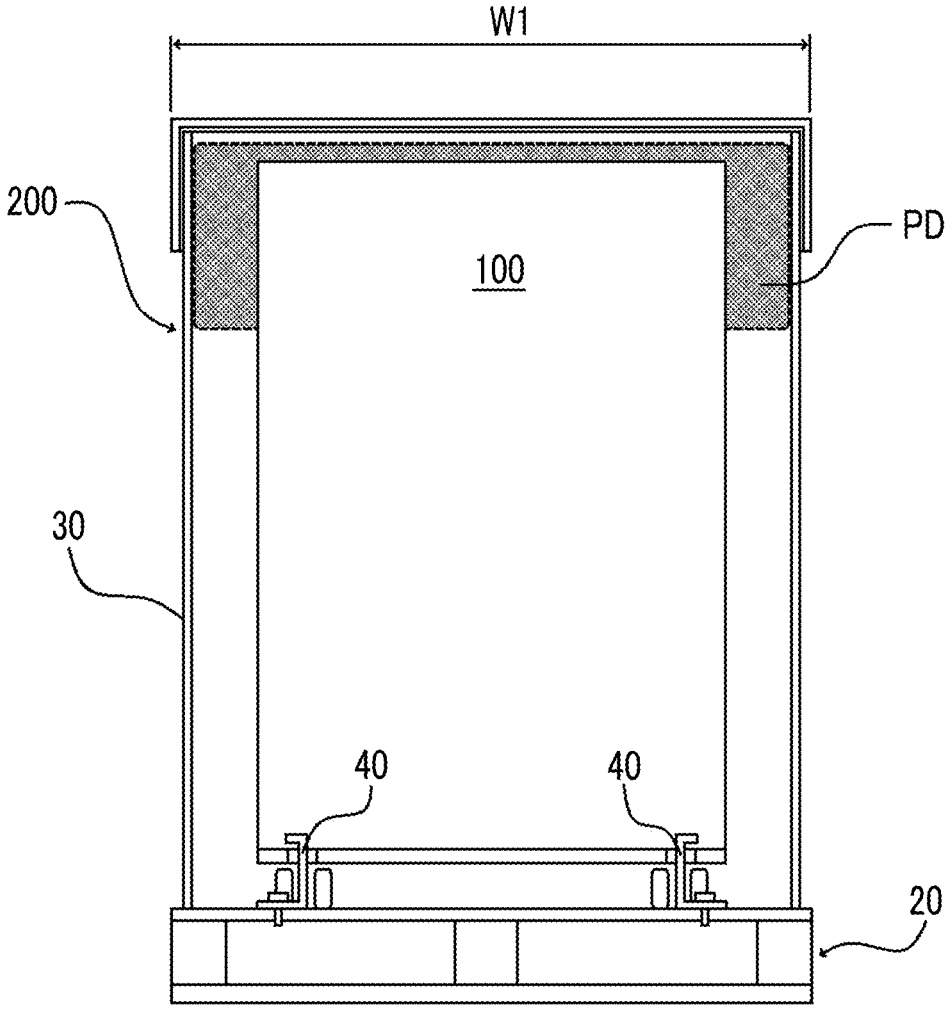
FIG. 12 is a schematic cross-sectional view showing the packing form of the packed body using a packing body of another comparative example, which has a buffer pad.
Figure 13:
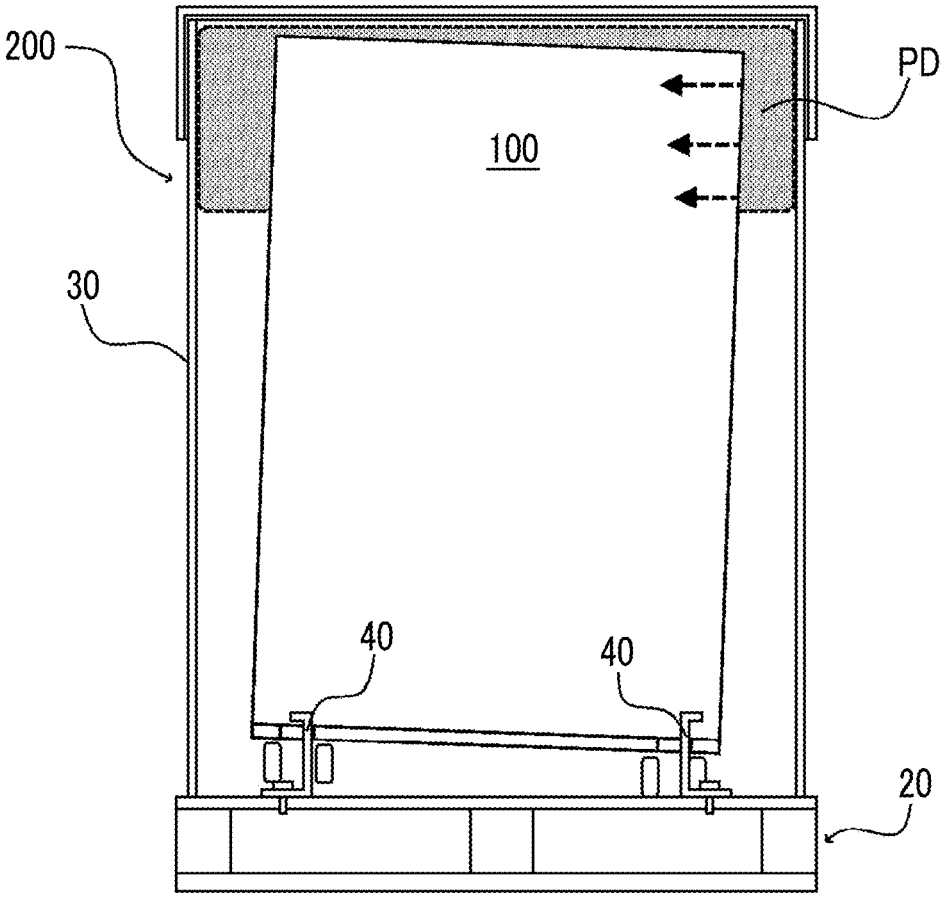
FIG. 13 is a schematic cross-sectional view showing behavior of the packed body at the time of a horizontal impact on the packing body of the comparative example, which has the buffer pad.

FIG. 5 is a schematic cross-sectional view showing the packing form of the packed body 100 using the packing body 10. FIGS. 6A and 6B are partially enlarged views for describing the placement of the packed body 100 on the pallet 20 by the restricting member 40. FIG. 12 is a schematic cross-sectional view showing the packing form of the packed body 100 using a packing body 200 of a comparative example, which has a buffer pad PD. FIG. 13 is a schematic cross-sectional view showing behavior of the packed body 100 at the time of a horizontal impact on the packing body 200 of the comparative example, which has the buffer pad PD.

As shown in FIG. 12, the packing body 200 according to the comparative example prevents lateral skidding of the packed body 100 at the time of transportation as the restricting member 40 restricts lateral movement of the lower end part of the packed body 100 placed on the pallet 20 and the buffer pad PD arranged between the packed body 100 and the box body 30 restricts lateral movement of the upper end part. On the other hand, the size of the packing body 200 (shown by a width W1 in FIG. 12) increases by the thickness of the buffer pad PD, and there is a possibility that loading efficiency declines.

As shown in FIG. 13, in a case where a horizontal impact is received by the packing body 200 in which the buffer pad PD is arranged, the impact on the packed body 100 is received only by the buffer pad PD. Thus, there is also a possibility that the impact is intensively received by the upper end part of the packed body 100, on which the buffer pad PD is arranged, as shown by arrows in the drawing, so that the packed body 100 is damaged.

As shown in FIG. 5, in the packing body 10 according to the present exemplary embodiment, the lateral movement of the lower end part of the packed body 100 placed on the pallet 20 is restricted by the restricting member 40, and the buffer pad PD is not arranged between the packed body 100 and the box body 30 at the upper end part. A gap G1 (see FIG. 6A) between the packed body 100 and the box body 30 is smaller than the comparative example having the buffer pad PD. Therefore, in a case where an impact is received in the horizontal direction, impact energy is received by the pallet 20 and the box body 30.

As shown in FIG. 6A, at the lower end part of the packed body 100, the restricting member 40 fixed to the top plate member 23 of the pallet 20 has entered the hole 111 provided in a base body 110, which is the bottom surface of the packed body 100, restricting the lateral movement of the packed body 100.

Specifically, clearance between the restricting member 40 and the hole 111 of the base body 110 of the packed body 100 is larger than the gap G1 between an inner surface 30*a* of the box body 30 and the packed body 100. Herein, the clearance refers to the amount of a space or a distance at which two objects can move relatively. In the present example, the clearance is clearance between the hole 111 and the restricting member 40, and is the amount of a distance at which the base body 110 having the hole 111 can move with respect to the restricting member 40 in a case where the packing body 10 has received an impact in the horizontal direction and has moved laterally. That is, the clearance is an amount obtained by adding an elastic deformation amount δ of the restricting member 40 in a case where the packed body 100 has moved horizontally and an edge 111*a* of the hole 111 has come into contact with the restricting member 40 to a gap G2 between the hole 111 and the restricting member 40.

As shown in FIG. 4B, the restricting member 40 is fixed to the top plate member 23 of the pallet 20 by a screw, and can deform elastically in the horizontal direction with the base part 41 as a base point in a case of receiving an impact force in the horizontal direction. For example, in the present exemplary embodiment, the restricting member 40 is likely to deform elastically in the horizontal direction in a case of receiving the impact force in the horizontal direction as the gap G2 between the hole 111 and the restricting member 40, which is obtained by subtracting the plate thickness t of the restricting member 40 from a width L1 of the hole 111, is set to 6.8 mm (gap on one side is 3.4 mm), the gap G1 between the inner surface 30*a* of the box body 30 and the packed body 100 is set to 5 mm, and the plate thickness t of the restricting member 40 is set to 1.6 mm, which is smaller than the plate thickness (2.3 mm) of the base body 110, as shown in FIG. 6A.

Specifically, in a case where the packing body 10 accommodating the packed body 100 has collided in the horizontal direction at a speed of 4.8 km/h, the elastic deformation amount δ of the restricting member 40 is 1.6 mm or more. As schematically shown in FIG. 6B, the packed body 100 moves horizontally without lateral movement thereof being restricted by the restricting member 40 on the pallet 20, and the entire surface of the packed body 100 comes into surface-contact with the inner surface 30*a* of the box body 30.

(3) Impact Absorption of Packing Body

Figure 7:
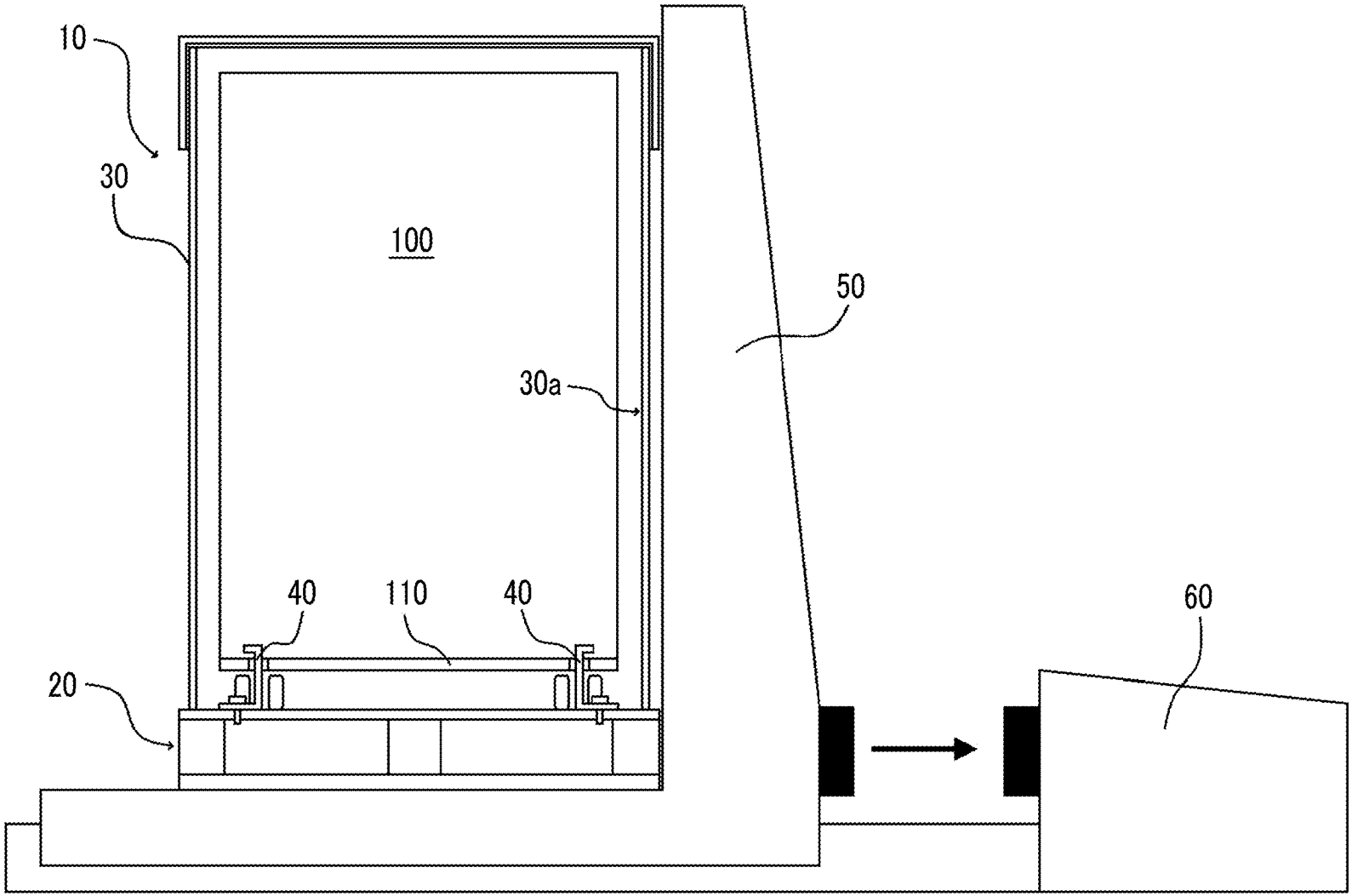
FIG. 7 is a view showing a horizontal impact test of the packing body.
Figure 8:
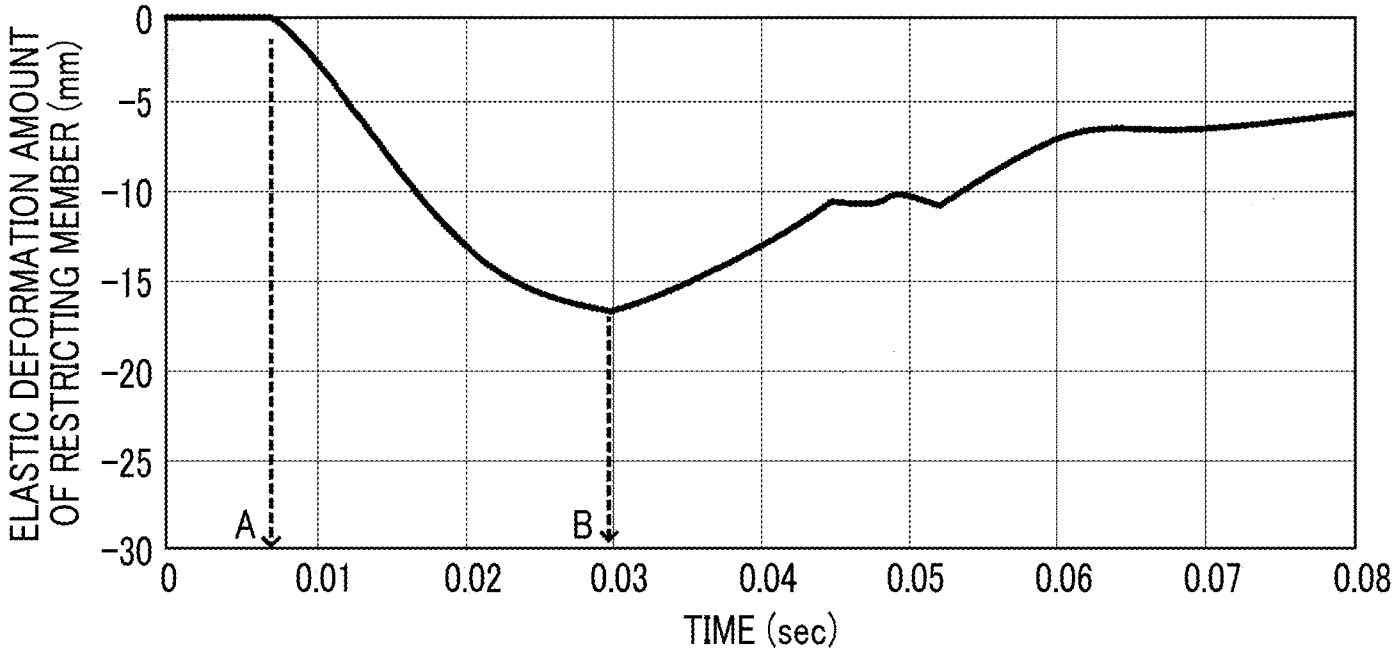
FIG. 8 is a graph showing an elastic deformation amount of the restricting member in the horizontal impact test.
Figure 9:
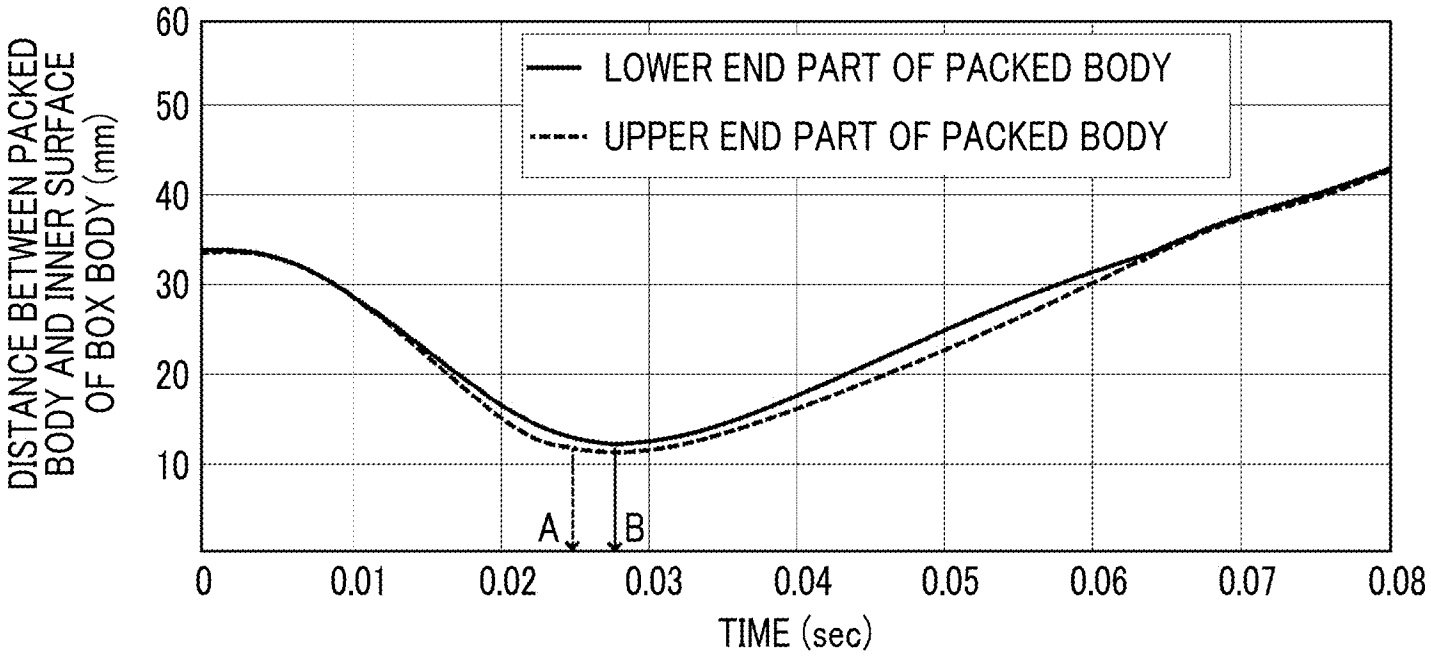
FIG. 9 is a graph showing contact of the packed body to an inner surface of the box body in the horizontal impact test.
Figure 10:
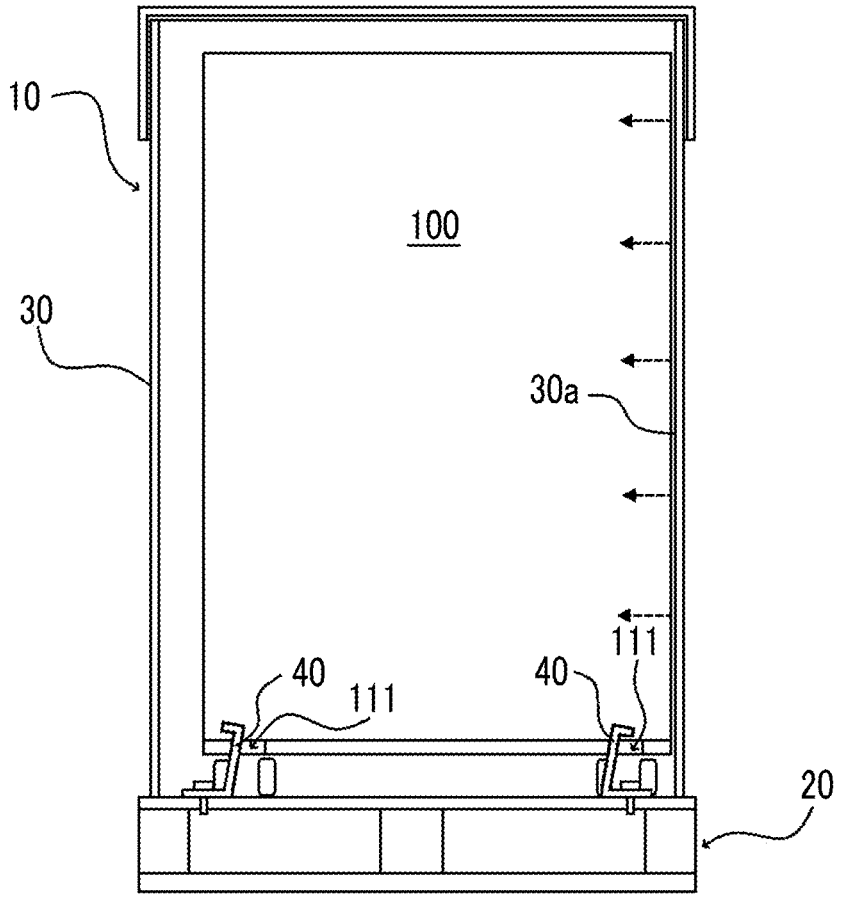
FIG. 10 is a view showing a state where the packed body has moved horizontally on the pallet and has come into contact with the inner surface of the box body in a case where the horizontal impact test has been performed.
Figure 11:
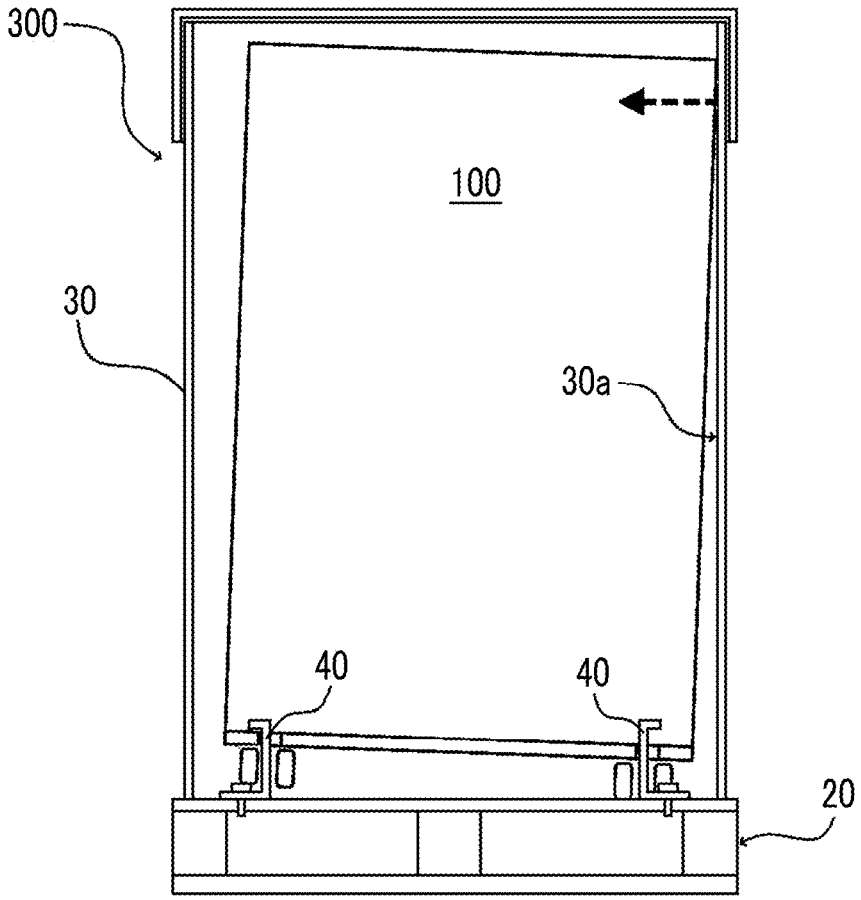
FIG. 11 is a view showing behavior of the packed body in a case where a packing body of a comparative example, in which the restricting member does not deform elastically, has received an impact force in a horizontal direction.

FIG. 7 is a view showing a horizontal impact test of the packing body 10. FIG. 8 is a graph showing an elastic deformation amount of the restricting member 40 in the horizontal impact test. FIG. 9 is a graph showing contact of the packed body 100 to the inner surface 30*a* of the box body 30 in the horizontal impact test. FIG. 10 is a view showing a state where the packed body 100 has moved horizontally on the pallet 20 and has come into contact with the inner surface 30*a* of the box body 30 in a case where the horizontal impact test has been performed. FIG. 11 is a view showing the behavior of the packed body 100 in a case where a packing body 300 of a comparative example, in which the restricting member 40 does not deform elastically, has received an impact force in the horizontal direction.

The horizontal impact test shown in FIG. 7 has been performed on the packing body 10 according to the present exemplary embodiment, and the impact absorption of the packing body 10 has been evaluated.

Since the packing body 10 according to the present exemplary embodiment described above includes, on a bottom surface side, the pallet 20 having the wooden girder member 22 configured by the plurality of vertical girders and horizontal girders between the bottom plate member 21 and the top plate member 23, transport by a forklift is possible.

At the distribution stage, for example, in a warehouse, the packing body 10 is transported in a state of being horizontally held by the forklift, is abutted against a wall surface to be aligned, and is stacked. At this time, there is a possibility that an end part of the pallet 20 and a side surface of the box body 30 receive an impact in the horizontal direction, and the packed body 100 is inclined on the pallet 20 and receives a partially large impact.

Example

As shown in FIG. 7, the horizontal impact test has been performed under a method of fixing the packing body 10 that has packed the packed body 100, which is covered with the box body 30 in a state where the packing body is placed on the pallet 20 and lateral movement thereof is restricted by the restricting member 40, to a sliding base 50 by a belt (not shown), and causing the sliding base 50 to slide in the horizontal direction at a speed of 4.8 km/h to collide with a pedestal 60. In the horizontal impact test, the packing body 10 is subject to a speed change of 4.8 km/h in the horizontal direction.

FIG. 8 shows a relationship between the elastic deformation amount δ (mm) of the restricting member 40 and time, in a case where the horizontal impact test has been performed under the method shown in FIG. 7. Although the elastic deformation amount of one restricting member 40, among the four restricting members 40 fixed on the pallet 20, is shown in FIG. 8, any one of the other three restricting members 40 has the same elastic deformation amount.

In FIG. 8, for approximately 0.008 sec (see A in the graph) after the collision, the packed body 100 moves horizontally within a range of the gap G2 of the hole 111 and does not come into contact with the restricting member 40, and the restricting member 40 does not deform elastically. Then, as the edge 111*a* of the hole 111 formed at the base body 110 of the packed body 100 comes into contact with the restricting member 40 with the horizontal movement of the packed body 100, the restricting member 40 deforms elastically by approximately 16 mm at approximately 0.03 sec (see B in the graph) after the collision, and after then, the deformation amount of the restricting member 40 decreases with the elapse of time.

That is, in a case where the pallet 20 on which the packed body 100 is placed has collided in the horizontal direction at a predetermined speed (4.8 km/h in the horizontal direction), the elastic deformation amount δ of the restricting member 40 in the horizontal direction is larger than the movement amount of the packed body 100 in the horizontal direction.

FIG. 9 shows a relationship between a change in a distance between the lower end part and the upper end part of the packed body 100 and the inner surface 30*a* of the box body 30 and time, in a case where the horizontal impact test has been performed under the method shown in FIG. 7. In FIG. 9, a distance between the upper end part of the packed body 100 and the inner surface 30*a* of the box body 30 decreases for approximately 0.025 sec (see A in the graph) after the collision, a distance between the lower end part of the packed body 100 and the inner surface 30*a* of the box body 30 decreases for approximately 0.027 sec (see B in the graph) after the collision, and a time difference is 0.002 sec (2 msec). That is, the upper end part and the lower end part of the packed body 100 collide with the inner surface 30*a* of the box body 30 with a time difference of 10 msec or less.

As described above, in a case where the pallet 20 on which the packed body 100 is placed has collided in the horizontal direction at a predetermined speed (4.8 km/h in the horizontal direction), a timing when the upper end part of the packed body 100 comes into contact with the inner surface 30*a* of the box body 30 is earlier than a timing when the lower end part of the packed body 100 comes into contact with the inner surface 30*a* of the box body 30.

FIG. 11 shows the behavior of the packed body 100 in a case of receiving an impact force in the horizontal direction in the packing body 300 of the comparative example, in which the restricting member 40 does not deform elastically in a case where the packed body 100 has moved horizontally and the edge 111*a* of the hole 111 has come into contact with the restricting member 40.

In a case where the restricting member 40 does not deform elastically, as shown in FIG. 11, the packed body 100 moves horizontally on the pallet 20 only by the gap G2 between the restricting member 40 and the hole 111 of the packed body 100, the upper end part is inclined with a contact part between the restricting member 40 and the hole 111 as a base point, and a partially large impact is received as shown by an arrow in the drawing.

FIG. 10 shows a state where the packed body 100 has moved horizontally on the pallet 20 and has come into contact with the inner surface 30*a* of the box body 30, in a case where the horizontal impact test has been performed under the method shown in FIG. 7.

In the packing body 10 of the present exemplary embodiment, by making the clearance between the restricting member 40 and the hole 111 of the packed body 100 larger than the gap G1 between the inner surface 30*a* of the box body 30 and the packed body 100, the packed body 100 moves laterally on the pallet 20 without being restricted by the restricting member 40, and the entire surface of the packed body 100 comes into surface-contact with the inner surface 30*a* of the box body 30 as shown by arrows in the drawing.

(4) Workings and Effects of Packing Body

In the packing body 10 according to the present exemplary embodiment, the clearance between the restricting member 40 and the hole 111 of the base body 110 of the packed body 100 is larger than the gap G1 between the inner surface 30*a* of the box body 30 and the packed body 100. The clearance includes the elastic deformation of the restricting member 40 in a case where the packed body 100 has moved horizontally and the edge 111*a* of the hole 111 has come into contact with the restricting member 40. In a case of receiving a horizontal impact, the packed body 100 moves horizontally on the pallet 20 at least by the amount of the clearance and is surface-abutted against the box body 30.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A packing module comprising:

a packed body; and a packing body, configured to accommodate the packed body, comprising:

a bottom plate on which the packed body is placed;

a box body that covers the packed body; and a restricting member, wherein the restricting member has a first end and a second end opposite to the first end, the first end is fixed to the bottom plate and the second end protrudes toward a base body of the packed body with a first gap between the restricting member and the base body of the packed body and that restricts lateral movement of the packed body by coming into contact with the base body of the packed body in a case where the packed body has moved laterally, wherein the restricting member is configured to penetrate through a hole provided in the base body of the packed body, wherein clearance between the restricting member and the hole of the base body of the packed body is larger than a second gap between an inner surface of the box body and the packed body, the clearance is defined as a movement amount which is a sum of an elastic deformation amount of the restricting member in a case where the packing body has received a horizontal impact and the first gap between the restricting member and the base body of the packed body, in a case where the bottom plate on which the packed body is placed has collide in a horizontal direction at a collision speed, the elastic deformation amount of the restricting member in the horizontal direction is larger than a movement amount of the packed body in the horizontal direction, and the collision speed in the horizontal direction is defined as 4.8 km/h.

2. The packing module according to claim 1, wherein in the case where the bottom plate on which the packed body is placed has collided in the horizontal direction at the collision speed, a timing when an upper end of the packed body comes into contact with the inner surface of the box body is earlier than a timing when a lower end of the packed body comes into contact with the inner surface of the box body.

3. The packing module according to claim 2, wherein a time difference between the timings is 10 msec or less.

4. The packing module according to claim 1, wherein a plate thickness of the restricting member is smaller than a plate thickness of the base body of the packed body.

5. The packing module according to claim 2, wherein a plate thickness of the restricting member is smaller than a plate thickness of the base body of the packed body.

6. The packing module according to claim 3, wherein a plate thickness of the restricting member is smaller than a plate thickness of the part of the packed body.

7. The packing module according to claim 4, wherein the restricting member is formed of high strength steel.

8. The packing module according to claim 5, wherein the restricting member is formed of high strength steel.

9. The packing module according to claim 6, wherein the restricting member is formed of high strength steel.

10. The packing module according to claim 1, wherein there is no buffer material between the packed body and the box body.

11. The packing module according to claim 2, wherein there is no buffer material between the packed body and the box body.

12. The packing module according to claim 3, wherein there is no buffer material between the packed body and the box body.

13. The packing module according to claim 4, wherein there is no buffer material between the packed body and the box body.

14. The packing module according to claim 5, wherein there is no buffer material between the packed body and the box body.

15. The packing module according to claim 6, wherein there is no buffer material between the packed body and the box body.

* * * * *